US010487412B2

(12) United States Patent
Miettinen et al.

(10) Patent No.: US 10,487,412 B2
(45) Date of Patent: Nov. 26, 2019

(54) CHROMIUM-CONTAINING COATING, A METHOD FOR ITS PRODUCTION AND A COATED OBJECT

(71) Applicant: Savroc Ltd, Kuopio (FI)

(72) Inventors: Juha Miettinen, Hiltulanlahti (FI); Jussi Räisä, Kuopio (FI)

(73) Assignee: Savroc Ltd, Kuopio (FI)

( * ) Notice: Subject to any disclaimer, the term of this patent is extended or adjusted under 35 U.S.C. 154(b) by 0 days.

(21) Appl. No.: 15/325,171

(22) PCT Filed: Jul. 11, 2014

(86) PCT No.: PCT/FI2014/050573
§ 371 (c)(1),
(2) Date: Jan. 10, 2017

(87) PCT Pub. No.: WO2016/005651
PCT Pub. Date: Jan. 14, 2016

(65) Prior Publication Data

US 2017/0159198 A1 Jun. 8, 2017

(51) Int. Cl.
*C25D 5/14* (2006.01)
*C25D 3/06* (2006.01)
(Continued)

(52) U.S. Cl.
CPC ..... *C25D 5/14* (2013.01); *C23C 28/021* (2013.01); *C25D 3/06* (2013.01); *C25D 5/50* (2013.01)

(58) Field of Classification Search
CPC ... C23C 18/1653; C23C 18/1692; C25D 5/12; C25D 5/14
(Continued)

(56) References Cited

U.S. PATENT DOCUMENTS 2,859,158 A 11/1958 Schaer
3,164,897 A 1/1965 Patriarca et al.
(Continued)

FOREIGN PATENT DOCUMENTS

CN 1099432 A 3/1995
CN 1497065 A 5/2004
(Continued)

OTHER PUBLICATIONS

Abstract of JP S60196209A, published 1985.
(Continued)

*Primary Examiner* — Tri V Nguyen
(74) *Attorney, Agent, or Firm* — Ware, Fressola, Maguire & Barber LLP

(57) ABSTRACT

The invention relates to a chromium-based coating comprising at least one layer rich in crystalline phase or phases of nickel (Ni) and/or Ni compounds, and at least one layer rich in crystal-line phase or phases of chromium (Cr) and/or Cr compounds, Cr being electroplated from a trivalent chromium bath. The coating is characterized in that the it further comprises one or more crystalline phases of chromium-nickel-phosphorus (CrNiP), which CrNiP phase has been produced by heat treating a coating comprising at least one layer of nickel-phosphorus (NiP) and at least one layer of Cr. The invention also relates to a method for producing a chromiumbased coating and to a coated object.

16 Claims, 5 Drawing Sheets

(51) Int. Cl.
*C25D 5/50* (2006.01)
*C23C 28/02* (2006.01)

(58) Field of Classification Search
USPC ..... 428/433
See application file for complete search history.

(56) References Cited

U.S. PATENT DOCUMENTS

| | | | |
|---|---|---|---|
| 4,461,680 | A | 7/1984 | Lashmore |
| 5,232,469 | A | 8/1993 | McEachron et al. |
| 5,252,360 | A | 10/1993 | Hüttl et al. |
| 5,271,823 | A | 12/1993 | Schachameyer et al. |
| 5,413,646 | A | 5/1995 | Dash et al. |
| 6,846,367 | B2 | 1/2005 | Nam et al. |
| 7,910,231 | B2 | 3/2011 | Schuh et al. |
| 9,347,145 | B2 | 5/2016 | Bessho |
| 2005/0249927 | A1* | 11/2005 | Suzuki ..... B32B 15/08 428/209 |
| 2009/0211914 | A1 | 8/2009 | Huang et al. |
| 2010/0025255 | A1 | 2/2010 | Su et al. |
| 2012/0111613 | A1 | 5/2012 | Oguro et al. |
| 2015/0132604 | A1 | 5/2015 | Sue et al. |
| 2015/0361571 | A1 | 12/2015 | Miettinen et al. |
| 2016/0333493 | A1 | 11/2016 | Miettinen et al. |
| 2016/0333494 | A1 | 11/2016 | Miettenen et al. |

FOREIGN PATENT DOCUMENTS

| | | | |
|---|---|---|---|
| CN | 101078132 | A | 11/2007 |
| CN | 101397685 | A | 4/2009 |
| CN | 101512047 | A | 8/2009 |
| CN | 101855388 | A | 10/2010 |
| CN | 102196675 | A | 9/2011 |
| CN | 102471913 | A | 5/2012 |
| CN | 102644067 | A | 8/2012 |
| CN | 102906311 | A | 1/2013 |
| CN | 103132114 | A | 6/2013 |
| CN | 103255454 | A | 8/2013 |
| EP | 0446762 | | 9/1991 |
| GB | 921977 | | 3/1963 |
| JP | S54124831 | | 9/1979 |
| JP | S60013094 | | 1/1985 |
| JP | S60196209 | A | 10/1985 |
| JP | H04214875 | | 8/1992 |
| JP | H06248472 | | 9/1994 |
| JP | H09095793 | | 4/1997 |
| JP | S63203792 | | 8/1998 |
| JP | 2002285375 | | 10/2002 |
| JP | 2005206915 | | 8/2005 |
| JP | 2007023316 | A | 2/2007 |
| JP | 2011179078 | | 9/2011 |
| JP | 2013091811 | A | 5/2013 |
| JP | S60196209 | A | 7/2014 |
| SE | 205488 | | 6/1966 |
| WO | 2007007790 | | 1/2007 |
| WO | 2011105392 | | 9/2011 |
| WO | 2014/111616 | A1 | 7/2014 |

OTHER PUBLICATIONS

Abstract of JP 2005206915, published 2004.
An Overview of Hard Chromium Plating Using Trivalent Chromium Solutions dated Jan. 31, 2011.
Magnetic properties and 61Ni Moessbauer spectroscopy of the ternary phosphide CrNiP, dated Jun. 24, 2008.
Machine Translation of JP2005206915, dated Mar. 24, 2015.
William Blum, et al., "Protective Value of Nickel and Chromium Plating on Steel," Part of Journal of Research of the National Bureau of Standards, vol. 13, pp. 331-355, Sep. 1934.
Mu, S. et al., "Investigation of a transparent chromate (III) passive film on electroless Ni-P coating by XPS and electrochemical methods," Electrochimica Acta, vol. 54 (2009), pp. 6718-6724.
Ching An Huang, et al., "Hardness variation and corrosion behavior of as-plated and annealed Cr—Ni alloy deposits electroplated in a trivalent chromium-based bath," 203 Surface & Coatings Technology 3686-3691, Jun. 6, 2009.
Ching An Huang, et al., "Microstructure analysis of a Cr—Ni multilayer pulse-electroplated in a bath containing trivalent chromium and divalent nickel ions," 255 Surface & Coatings Technology 153-157, Apr. 8, 2014.
Zhang, et al., "Practical Electroplating Additive," Ed. 1, pp. 451-460, Chemical Industry Press, 2007.
Jingli Fang, "Electroplating Coordination Compound-Theory and Application," pp. 504-508, 511-514, Chemical Industry Press, 2008.
English Translation of JPS60196209 Description, generated by European Patent Office, dated Oct. 4, 1985.
Benaben, Patrick, "An Overview of Hard Chromium Plating Using Trivalent Chromium Solutions", https://www.pfonline.com/articles/an-overview-of-hard-chromium-plating-using-trivalent-chromium-solutions, Jan. 31, 2011.
Stadnik, Z.M., et al., "Magnetic properties and 61Ni Mossbauer spectroscopy of the ternary phosphide CrNiP", 20 Journal of Physics: Condensed Matter, Jun. 14, 2008.
Official Journal of the European Union, "Directive 2002/95/EC of the European Parliament and of the Council of Jan. 27, 2003 on the restriction of the use of certain hazardous substances in electrical and electronic equipment", Feb. 13, 2003 (258 pags).
Roshan Chapaneri, "A study of hexavalent and trivalent chromium conversion coatings on zinc surfaces", Mar. 2010 (18 pages).
Lanxess Deutschland GmbH et al., "Analysis of Alternatives", Sep. 2016, available at https://echa.europa.eu/documents/10162/70ae9192-4c86-4e68-9021-0a90f7b56444 (180 pages).

* cited by examiner

CHROMIUM-CONTAINING COATING, A METHOD FOR ITS PRODUCTION AND A COATED OBJECT

FIELD OF THE INVENTION

The invention relates to a chromium-based coating and a method for producing a chromium-based coating. The invention also relates to an object coated with a chromium-based coating.

BACKGROUND OF THE INVENTION

Chromium coating is widely used as a surface coating for different articles because of its high hardness value, attractive appearance and superior wear and corrosion resistance. Traditionally, Cr deposition is accomplished by electroplating from an electrolytic bath containing hexavalent Cr ions. The process is highly toxic in nature. Lots of efforts have been made to develop alternative coatings and coating processes to replace hexavalent Cr in electroplating. Among those alternative processes, trivalent Cr electroplating seems to be attractive due to its low cost, convenience of fabrication through the use of environmental friendly and non-toxic chemicals, and ability to produce a bright Cr deposit. However, an industrial scale process giving a hard and corrosion resistant Cr deposit through an aqueous trivalent chromium solution is still missing.

Many chromium plating processes of prior art are not capable of producing coatings with a Vickers microhardness value of 2000 HV or more. Further defects of the known chromium-based coatings are their inadequate wear and corrosion resistances. Chromium coating as such is very brittle in character. The number of cracks and micro-cracks in a chromium coating increases together with the thickness of the coating, thus impairing the corrosion resistance of the coating.

Deposition of nickel, either by electroless plating or electroplating, has also been proposed as an alternative to hard chrome. Drawbacks of nickel plating include deficiencies in hardness, friction coefficient and wear resistance. Nickel plating and chrome are not interchangeable coatings. The two have unique deposit properties and, therefore, each has its distinct applications.

It is well known in the art that the hardness of a chromium coating can be improved, to some extent, by thermal treatment. According to P. Benaben, An Overview of Hard Cromium Plating Using Trivalent Chromium Solutions, http://www.pfonline.com/articles/an-overview-of-hard-chromium-plating-using-trivalent-chromium-solutions, the microhardness of a chromium deposit as-plated is about 700-1000 $HV_{100}$. By a heat treatment at 300-350° C. the microhardness of trivalent Cr can be increased up to about 1700-1800 $HV_{100}$. At higher temperatures the hardness of the Cr deposit tends to decrease. Adhesion of a trivalent Cr layer is known to cause problems. The process chemistry of known trivalent Cr baths is often very complicated and hard to manage.

In patent document GB 921,977 a process for producing a nickel-chromium alloy coating on a metal base is disclosed. The process comprises applying a powdered alloy of nickel, chromium and phosphorus in an amount to provide from at least about 1 to about 4 grams of said fused alloy per square foot of fused coated surface. The base is then heated in a protective non-oxidizing atmosphere at a temperature and for a time sufficient to melt the powdered alloy. Thereby a continuous fusion coating of said alloy on the surface of said base is provided.

In patent document U.S. Pat. No. 5,232,469, a multi-layer coated diamond abrasive particles having improved wear performance are disclosed. The coating comprises a single homogenous, carbide forming metal primary layer, preferably of chromium, and at least one non-carbide forming secondary layer applied by electroless deposition, preferably comprised of nickel/phosphorus or cobalt/phosphorus.

The compound chromium-nickel-phosphate (CrNiP) is a ternary phosphide whose crystal structure has been studied. The production of CrNiP is known from studies concentrating on its crystal properties. In Stadnik et al. (Magnetic properties and $^{61}$Ni Mössbauer spectroscopy of the ternary phosphide CrNiP; J. Phys.: Condens. Matter 20 (2008) 285227), crystalline CrNiP was produced by mixing pure powders of Cr, Ni and P, sealing the mixture in an evacuated silica tube and heating at 873 K for 2 days. After this, the reaction product was quenched and subjected to a vacuum heat treatment at 1073 K for 2 days and then quenched. The ingot was pulverized, mixed well and heated at 1173 K for 7 days, after which the reaction product was quenched.

The hardness, friction coefficient, wear and corrosion resistance of known trivalent Cr coatings are not sufficient to satisfy the demands of industry. Apparently, there is a need for a chromium-based coating which is able to yield such utmost mechanical properties that enable replacement of hexavalent chromium baths.

PURPOSE OF THE INVENTION

The purpose of the invention is to eliminate, or at least reduce, at least one of the problems faced in the prior art. A further purpose of the invention is to provide a new type of a chromium-based coating having improved properties, such as high hardness, good sliding wear resistance and improved corrosion resistance.

SUMMARY

The chromium-based coating according to the present invention is characterized by what is presented in the claims.

The method for producing a chromium-based coating according to the present invention is characterized by what is presented in the claims.

An object coated by the chromium-based coating according to the present invention is characterized by what is presented in the claims.

The present disclosure relates to a chromium-based coating comprising at least one layer rich in crystalline phase or phases of nickel (Ni) and/or Ni compounds, and at least one layer rich in crystalline phase or phases of chromium (Cr) and/or Cr compounds. Cr in the coating is electroplated from a trivalent chromium bath and the coating is characterized in that it further comprises one or more crystalline phases of chromium-nickel-phosphorus (CrNiP), which CrNiP phase has been produced by heat treating a coating comprising at least one layer of nickel-phosphorus (NiP) and at least one layer of Cr.

By a layer is herein meant a segment of a coating that is substantially parallel to the surface of a coating and is distinguishable in an electron micrograph (such as transmission electron micrograph, TEM, or scanning electron micrograph, SEM), light micrograph or by energy-dispersive X-ray spectroscopy (EDS). The visibility of the layers can be improved by using methods such as etching or ion etching during cross-sectioning of the coating to be analyzed. The boundaries between layers do not need to be well defined. On the contrary, during a heat treatment, the boundaries of the layers mix to some extent. Without limiting the invention according to the present disclosure to any specific theory, there might be some amount of migration or diffusion of layer components during the heat treatment. The extent to which the components might be migrating or diffusing depends, for example, on the duration and intensity of the heat treatment and the layer components.

By a layer that is rich in a phase or phases of Ni and/or its compounds or Cr and/or its compounds is herein meant a layer that contains at least 50% (w/w) of the elemental metal and/or its compounds, and/or substances in which the metal is present.

By an interface layer is herein meant a layer that shares some properties with the neighboring layers, but remains distinguishable from them. Especially an interface layer contains Cr and/or Ni or their compounds, but to a lesser extent that the layer rich in the phase or phases of the said metal or its compounds.

By a phase is herein meant a region in which the physical properties of the substance are constant. One layer can comprise a single phase or it can comprise more than one phase, each of which can be formed of one or more element, substance or compound. A layer can comprise more than one element, substance or compound, in which case each of them can independently comprise one or more phases. In every case in which there are two or more phases in a layer—representing one or more element, substance or compound—the layer is called a multiphase layer. In one embodiment, at least one of the layers is a multiphase layer. In another embodiment, the crystalline CrNiP phase(s) is/are a component of at least one multiphase layer. In yet another embodiment, at least one of the layers is a multiphase layer and comprises, in addition to crystalline Cr, at least one of the following: crystalline CrNiP, crystalline CrNi, crystalline Ni, chromium carbide or chromium oxide, or a combination thereof. The term chromium carbide is herein to be understood to include all the chemical compositions of chromium carbide, such as $Cr_3C_2$, $Cr_7C_3$, and $Cr_{23}C_6$. The term chromium oxide is herein to be understood to include all the stable chemical compositions of chromium oxide, such as CrO, $Cr_2O_3$, $CrO_2$, $CrO_3$ and its mixed valence species, for example $Cr_8O_{21}$.

Due to the method of manufacture, the coating typically contains further elements in addition to Cr, Ni and P. For example iron (Fe), copper (Cu), carbon (C) and oxygen (O) are typically present. They may exist as pure elements or in various compounds or mixtures with Cr, Ni and P or each other.

In this disclosure, unless otherwise state, electroplating, electrolytic plating and electrodeposition are to be understood as synonyms. Similarly, electroless plating, electroless deposition and chemical deposition are to be understood as synonyms. By depositing a layer on the object is herein meant depositing a layer directly on the object to be coated or on the previous layer that has been deposited on the object. In the present disclosure, Cr is deposited through electroplating from a trivalent Cr bath. In this connection, the wording "electroplating from a trivalent chromium bath" is used to define a process step in which a chromium layer is deposited from an electrolytic bath in which chromium is present substantially only in the trivalent form.

CrNiP phase according to the present disclosure can be formed in any part of the layers or in the interface layers between the layers. All locations where all of its three constituent elements are present are possible sites for its formation. Without limiting the current disclosure to any specific theory, the most favorable conditions for the formation of the CrNiP phase might prevail in locations where $Ni_3P$ and Cr are present during the heat treatment. In one embodiment, the crystalline CrNiP phase(s) form(s) an interface layer between a layer rich in crystalline phase(s) of Ni and/or Ni compounds and a layer rich in crystalline phase(s) of Cr and/or Cr compounds. In one embodiment, at least one of the CrNiP-containing layers is an interface layer.

Several atomic ratios are known for crystalline CrNiP. In the current disclosure, the term CrNiP is meant to comprise any of the atomic ratios which it can have. In one embodiment, the atomic ratio of the CrNiP phase is, for example, $Cr_{10.08}Ni_{1.92}P_7$, $Cr_{0.75}Ni_{0.25}P$, $Cr_1Ni_1P_1$, $Cr_{2.4}Ni_{0.6}P$, $Cr_{0.65}Ni_{0.35}P_{0.10}$, $Cr_{1.2}Ni_{0.8}P$ or any combination thereof. CrNiP can exist in two crystal structure types, namely tetragonal and orthorhombic. In one embodiment, the CrNiP phase comprises tetragonal CrNiP and/or orthohrombic CrNiP.

The thickness of the Cr-containing layer(s) can vary widely depending on the application. For decorative coating applications, a thinner layer is necessary than for corrosion or wear-resistant coating applications. In one embodiment, the thickness of at least one of the crystalline chromium-containing layers is 0.05-20 μm, preferably 0.3-10 μm, more preferably 2-7 μm.

The thickness of the coating depends on the number and thickness of the layers it comprises. In one embodiment, the thickness of the coating is 0.5-200 μm. The thickness and the composition of both the coating and its constituent layers together determine the properties of the coating. Typically coatings according to the present disclosure are very hard. They can be used to replace traditional hard chromium coatings. In one embodiment, the hardness of the coating is at least 1,500 $HV_{0.005}$, preferably at least 2,000 $HV_{0.005}$ on a Vickers microhardness scale.

The abrasion wear of a coating can be measured for example by the Taber abrasion test. The result is expressed as a Taber index, where a smaller value indicates higher abrasion resistance. Typical values of hard chromium coatings range from 2 to 5 when the test is done according to the standard ISO 9352. The test was performed with TABER 5135 Abraser, the type of the wheel was CS 10, rotation speed 72 rpm, load 1,000 g and the total number of cycles 6,000. The wear was determined by measuring the initial weight of the object, intermediate weights after every 1,000 cycles and the end weight of the object after finishing the test. The coating according to the present disclosure has excellent abrasion resistance indicated by a Taber index of 2 and below under the same test conditions. In one embodiment, the Taber index of the coating measured by the Taber abrasion test according to ISO 9352 is below 2, preferably below 1.

In another aspect, a method for producing a chromium-based coating on an object by trivalent chromium plating is disclosed. The method comprises the steps of a) depositing a layer of nickel phosphorus alloy (NiP) on the object;

b) depositing a layer of chromium from a trivalent chromium bath on the object; and c) subjecting the coated object to at least one heat treatment at a temperature of 650-950° C., preferably at a temperature of 750-900° C., to amend the mechanical and physical properties of the coating and to produce a CrNiP phase.

At step a), nickel-phosphorus alloy is deposited on the object to be coated. NiP layer can be deposited by electroless plating or electroplating. It can be deposited, for instance, from a solution formulated with sodium hypophosphite as a reducing agent. The phosphorus content of the NiP alloy can be in the range of 1-15%, preferably 3-12%, more preferably 5-9%. The thickness of the layer rich in crystalline phase(s) of Ni and/or Ni compounds can vary between 0.5 and 20 μm and is typically 1-8 μm. Without limiting the current invention to any specific theory, heat treatment of NiP alloy can at least partially convert NiP into crystalline $Ni_3P$. Crystalline $Ni_3P$, again, might participate in the formation of crystalline CrNiP. In one embodiment, at least one of the layers rich in crystalline phase or phases of Ni and/or Ni compounds comprises a crystalline $Ni_3P$ phase.

In step b), chromium is deposited from trivalent chromium bath on the object to be coated. In practice, the chromium is deposited on the previously formed NiP layer. The chromium electroplating step can be carried out using any commercially available Cr(III) bath. One example of an electrolyte solution that has been used in the trivalent chromium coating step is the one sold by Atotech Deutschland GmbH under trade name Trichrome Plus®.

In step c), the coated object is subjected to one or more heat treatments, the purpose of which is to improve the physical and mechanical properties of the multilayer coating and to form the CrNiP phase(s). The at least one heat treatment for producing the CrNiP phase according to the present disclosure is performed at a temperature of 650-950° C., preferably at a temperature of 750-900° C. Without limiting the current invention to any specific theory, temperatures of approximately 650° C. or higher promote the formation of the CrNiP phase. Step c) can comprise pre-heating to, for example, 300-500° C. before heating to a higher temperature of 650° C. or above. Without limiting the current invention to any specific theory, pre-heating might condition the substrate and/or the layers present in the coating for increased hardness and/or adhesion of the coating to the substrate. In one embodiment, step c) comprises heating first to 400° C. for a predetermined time and then to 650-950° C., preferably to 750-900° C.

Heat treatments can be carried out, for instance, in a conventional gas furnace in ambient gas atmosphere or in in a protective gas atmosphere, in which case the duration of one heat treatment can be 10-60 minutes. Alternatively, heat treatments can be carried out by induction, flame heating, laser heating or salt bath heat treatment. Induction heating is a no-contact process that quickly produces intense, localized and controllable heat. With induction, it is possible to heat only selected parts of the coated metal substrate. Flame heating refers to processes where heat is transferred to the object by means of a gas flame without the object melting or material being removed. Laser heating produces local changes at the surface of the material while leaving the properties of the bulk of a given component unaffected. Heat treating with laser involves solid-state transformation, so that the surface of the metal is not melted. Both mechanical and chemical properties of a coated article can often be greatly enhanced through the metallurgical reactions produced during heating and cooling cycles.

According to one embodiment of the present invention, at least two heat treatments are carried out after the desired number of layers has been deposited on the object. Especially if the object to be coated with the coating according to the present disclosure is steel that has already been hardened, it is beneficial to perform two heat treatments. Without limiting the current disclosure to any specific theory, the first heating can de-harden the object and thus make it amenable to receive a durable coating. It is also possible that the first heat treatment turns at least part of the NiP alloy into crystalline $Ni_3P$ which might promote the formation of the CrNiP phase.

When the heat treatment is done in two steps and the first one is done in a furnace, the object is typically cooled to near room temperature before the second heat treatment. After that, the second heat treatment can be done either in a furnace or through induction heating. It is, however, possible not to cool the object between heat treatments.

When the heat treatment is done in two steps and the first one is done through induction heating, the object is typically not cooled before the second heat treatment if the second heat treatment is carried out as induction heating. However, cooling the object is possible also in this case, and it is typically done, if the second heat treatment is performed in a furnace. In one embodiment, the at least one heat treatment in step c) is induction heating or furnace heating.

For the formation of the CrNiP layer according to the present disclosure it is irrelevant whether the object is cooled quickly, for example with a water jet, or slowly, for example by leaving it in ambient temperature. However, if the heat treatment aims at hardening the coated object with the same heat treatment as the coating is finalized, the cooling has to be effected quickly.

In one embodiment, the heat treatment of step c) is induction heating and the object is cooled by cooling liquid 0.1-60 seconds, preferably 0.5-10 seconds, more preferably 0.8-1.5 seconds, after the end of the heating. One way of effecting the induction heating and the subsequent cooling is to pass the object to be treated through a stationary induction coil that is situated at a predetermined distance from a stationary jet of cooling liquid. After the object exits the induction coil, it will move to the jet of cooling liquid. Alternatively the object to be treated can be stationary and the induction coil and cooling stream moving. Thus, the lag time between the end of the heating and the beginning of the liquid cooling can be controlled by the relative speeds of the object to be treated and the heating and cooling means. In one embodiment, the heat treatment of step c) is induction heating, the distance between the heating coil and the cooling jet is 25 mm and the speed of the induction coil and the cooling liquid jet relative to the object to be heated is 500-3,000 mm $min^{-1}$, preferably 1,500 mm $min^{-1}$. The cooling liquid can be, for example, water or suitable emulsion.

In one embodiment, the method comprises an additional step i) before step a) to improve the adhesion between the adjacent layers.

In one embodiment, step i) comprises depositing a strike layer. A strike layer can be used to improve the adhesion between two layers. Strike layer can be deposited on the substrate to be coated in case the substrate is stainless steel. Typically, a strike layer is deposited on a layer rich in crystalline phase or phases of chromium (Cr) and/or Cr compounds if another layer is to be deposited on it. The strike layer can comprise, for instance, sulphamate nickel, bright nickel, Watts type nickel, Woods type nickel, copper or any other suitable material. For example, to produce a nickel strike layer, the object is immersed into a nickel salt-containing bath, through which an electric current is passed, resulting in the deposition of a nickel layer on the substrate. For instance, a nickel strike layer can be electroplated on the object from a nickel sulphamate bath before the electroless deposition of nickel phosphorus alloy. The thickness of the nickel strike layer can be, for instance, in the range of 0.1-10 μm. In one embodiment, the strike layer comprises Ni and is deposited from a bath comprising sulphamate nickel having a pH value of 2 or below.

In one embodiment, step i) further comprises treating the object with an strong acid, preferably with 30% (w/w) hydrochloric acid, before depositing the strike layer. The acid treatment is short, for example 1 second. Generally, this type of a treatment is called an acid-dip (i.e. pickling) treatment and the length of the process can vary in a range that is known to the skilled person. In addition to hydrochloric acid, other acid-dip processes might be suitable for the acid treatment as well. An acid treatment is especially beneficial to perform before the deposition of the strike layer if the surface is of stainless steel or rich in chromium or chromium compounds.

In one embodiment, the method comprises an additional step d) of depositing a top layer after step c) by thin film deposition, such as physical vapor deposition (PVD), chemical vapor deposition (CVD), atomic layer deposition (ALD) or electroplating or electroless plating. The methods for producing a top layer are well established and selecting a suitable one and adjusting its parameters is within the knowledge of the skilled person. The top layer can be made of any suitable material that is able to give the coated surface the desired properties. Suitable materials comprise, for instance, metals, metal alloys, ceramics, nitrides (TiN, CrN), and diamond like carbon (DLC). Also NiP can be deposited as the top layer. In most applications, the coated object is first heat treated and then a top layer is deposited. In one embodiment, the method comprises an additional step d) of depositing a top layer before step c) by thin film deposition, such as physical vapor deposition (PVD), chemical vapor deposition (CVD), atomic layer deposition (ALD) or electroplating or electroless plating. In other words, it is possible to produce a thin film deposited top layer on the coated object before a heat treatment. It is also possible that step d) comprises a heat treatment on its own. In this case, the heat treatment is optimized for completion of the top layer and therefore its parameters can be different from those of the heat treatment in step c) of the current method. Selecting heat treatment parameters for finalizing the top layer is within the knowledge of the skilled person.

In one embodiment, the chromium-based coating is a multilayer coating comprising at least two layers rich in crystalline phase or phases of Ni and/or Ni compounds and at least two layers rich in crystalline phase or phases of Cr and/or Cr compounds. Multilayer coating can have any number of Ni-containing and Cr-containing layers depending on the application and desired coating properties. A multilayer coating is produced by repeating the deposition steps a), b) and c) for the desired number of times. Additional steps i) and d) can be included when necessary or desired.

In one embodiment of the method according to the present disclosure, the steps a) and b) are repeated at least once before step c) to produce a multilayer coating containing at least two layers rich in crystalline phase or phases of nickel (Ni) and/or Ni compounds and at least two layers rich in crystalline phase or phases of chromium (Cr) and/or Cr compounds.

It is possible to first produce a number of layers by repeating steps a) and b) at least once and then performing step c), i.e. heat-treating the object at the end of the procedure. Especially, the steps can be done in the order first a), then b), then i) and repeating steps a) and b) at least once before step c). If steps a) and b) are repeated more than once, step i) is performed after step b) if step a) is to follow. In case the substrate is made of hardened or acid-resistant material, such as stainless steel, step i) can be performed before step a) is performed the first time. In other words, the sequence of steps can be first i), then a), then b) and these three steps can be repeated in this order at least once before step c).

Step c) of heat-treating the object can alternatively be performed directly after each time steps a) and b) are performed. In other words, the method can start with step a), after which step b) is carried out followed by step c). After this, step i) can be carried out and steps a), b) and c) repeated. As above, for acid-resistant and hardened substrate materials, step i) can be carried out first. In one embodiment, the steps a), b) and c) are repeated at least once.

Although for many applications, having a Cr-containing layer on the surface of the coating is beneficial, applications exist where NiP- or $Ni_3P$-containing layer closest to the surface is preferred. For example, nickel-phosphate compounds lend themselves for coloring or other modifications. As an example, acid post dip processes can be used for producing a darker-colored surface, which can be black in extreme cases. Processes for producing black NiP coatings are known in the art. In one embodiment, the layer closest to the surface of the coating comprises crystalline Cr. In one embodiment, the layer closest to the surface of the coating comprises NiP or crystalline $Ni_3P$. It is thus possible that the last steps of any of the above-mentioned method alternatives are step a) followed directly by step c).

Any of the process alternatives described above can further comprise step d), i.e. the deposition of a top layer. It is carried out after the last time step c) has been performed. Alternatively be step d) can be performed before step c).

In one embodiment, the object to be coated is of metal and the hardening of the metal of the object is carried out at the same time as the coated object is heat treated. When the coated article is an object of metal, it is also possible to harden the metal of the object during the heat treatment of the coating. Hardening is a metallurgical process used to increase the hardness of a metal. As an example, steel can be hardened by cooling from above the critical temperature range at a rate that prevents the formation of ferrite and pearlite and results in the formation of martensite (quenching). Hardening may involve cooling in water, oil or air, according to the composition and size of the article and the hardenability of the steel. In case the hardening of a metal object is carried out in connection with a heat treatment of the coated object, it is possible to subsequently subject the object to annealing or tempering in a second heat treatment, which is carried out after quenching. It is also possible to subject an already hardened metal object to a further hardening during the heat treatment of the coated object even though the metal object had originally been hardened before the coating.

In one embodiment, the object to be coated is a hardened steel shaft and step i) is performed first, then step a), then step b), then step c), wherein step c) comprises first heating at 300-500° C. and then at 750-870° C., and wherein the method comprises the further step of cooling with a cooling liquid within 60 seconds, preferably within 10 seconds, more preferably within 1.5 seconds from the end of step c). In one embodiment, the method comprises a further step of tempering at a temperature of 200-400° C. after cooling with a cooling liquid. In one embodiment, the hardened steel rod is a rod of a shock absorber or a rod of a hydraulic cylinder.

For simultaneous heat treatment and hardening of the object, especially induction heating is suitable, since it is uniform and the hardening of the metal object can be achieved only in the vicinity of the surface, in the range of few millimeters below the surface.

The method according to the present disclosure can comprise further process steps. These can be for example pretreatment steps. An example of such is chemical and/or electrolytic degreasing to remove oil and dirt from the surface to be coated. Another example is pickling to activate the surface before the actual coating and plating steps. Also additional protective layers can be used. As an example a coating comprising copper or zinc can be used as a temporary protective layer. Such a coating can be removed by, for example dissolving with a suitable solution (e.g. acid) or grinding, to expose the coating according to the present disclosure. These pre- and post-treatment steps belong to the knowledge of the skilled person and can be selected according to the intended application.

In another aspect, a coated object is disclosed. The coated object is characterized in that it comprises a coating according to the claims or a coating produced by a method according to the claims. The object that is coated can be of any material, such as ceramic, metallic or metal alloy material that is used for functions requiring high hardness and corrosion resistance. There are many applications in which a coated object according to the present disclosure can be used. In one embodiment, the coated object is a gas turbine, shock absorber, hydraulic cylinder, linked pin, a ball valve or an engine valve. These are typical applications requiring good corrosion and wear resistance and hardness, but other applications can be envisaged.

An advantage of the invention according to the present disclosure is that it is possible to produce coatings having an excellent corrosion resistance and an extremely high and adjustable hardness (Vickers microhardness 1000-2500 $HV_{0.005}$) through a safe and less toxic process than hexavalent chromium containing processes.

Another advantage of the invention according to the present disclosure is that it is possible to prepare the coating and to surface-harden the object to be coated to a depth of a few millimeters without affecting the strength of core of the object. This advantage is especially prevalent for steel shock absorbers.

Another advantage of the invention according to the current disclosure is that a multilayer coating can be formed in which the microcracks inherent for chromium coatings do not reach the substrate material through the Ni-containing layers. This improves the corrosion resistance of the material.

Yet another advantage of the invention according to the present disclosure is that in a multi-layer coating, the constituting layers can remain thin and do not become brittle as thicker layers of chromium. This is evident the reduced delaminating characteristics and cracking of the coating.

The coating according to the present disclosure has even thickness, which offers another advantage, as the object does not require post-grinding. This advantage is especially prevalent for ball valves and hydraulic cylinders.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Reference will now be made in detail to the embodiments of the present invention, an example of which is illustrated in the accompanying drawings.

The description below discloses some embodiments of the invention in such a detail that a person skilled in the art is able to utilize the invention based on the disclosure. Not all steps of the embodiments are discussed in detail, as many of the steps will be obvious for the person skilled in the art based on this specification.

Example 1—Preparation of a Chromium-Containing Coating

A steel object was coated with a coating according to the present disclosure. A nickel strike layer was first deposited on the steel substrate (step i)) Then, a 3 μm thick NiP layer was chemically deposited on the object (step a)), after which a 5 μm thick Cr layer was electroplated on it (step b)). This was followed by a brief acid treatment with 30% (w/w) HCl and deposition of a 1 μm Ni strike layer (step i)). After this, steps a) and b) were repeated. Then, the object was heated in a furnace at 850° C. for 30 minutes to amend the mechanical and physical properties of the coating and to produce a CrNiP phase (step c).

X-ray diffraction spectra (XRD) of the chromium-containing coating were measured to get information about the crystalline structure of the coating after heat treatment. Most crystalline materials have unique X-ray diffraction patterns that can be used to differentiate between materials. The peaks of the XRD spectrum were identified by comparing the measured spectrum with the X-ray diffraction patterns of the elements known to be contained in the coating.

Sometimes the top-most layer of a coating to be analyzed can be too thick for performing an XRD analysis directly. In such a case, it is necessary to thin the top-most layer of the coating by, for example, grinding. Thinning methods are known to a skilled person that do not heat the sample so that the properties of the coating would change.

Figure 1:
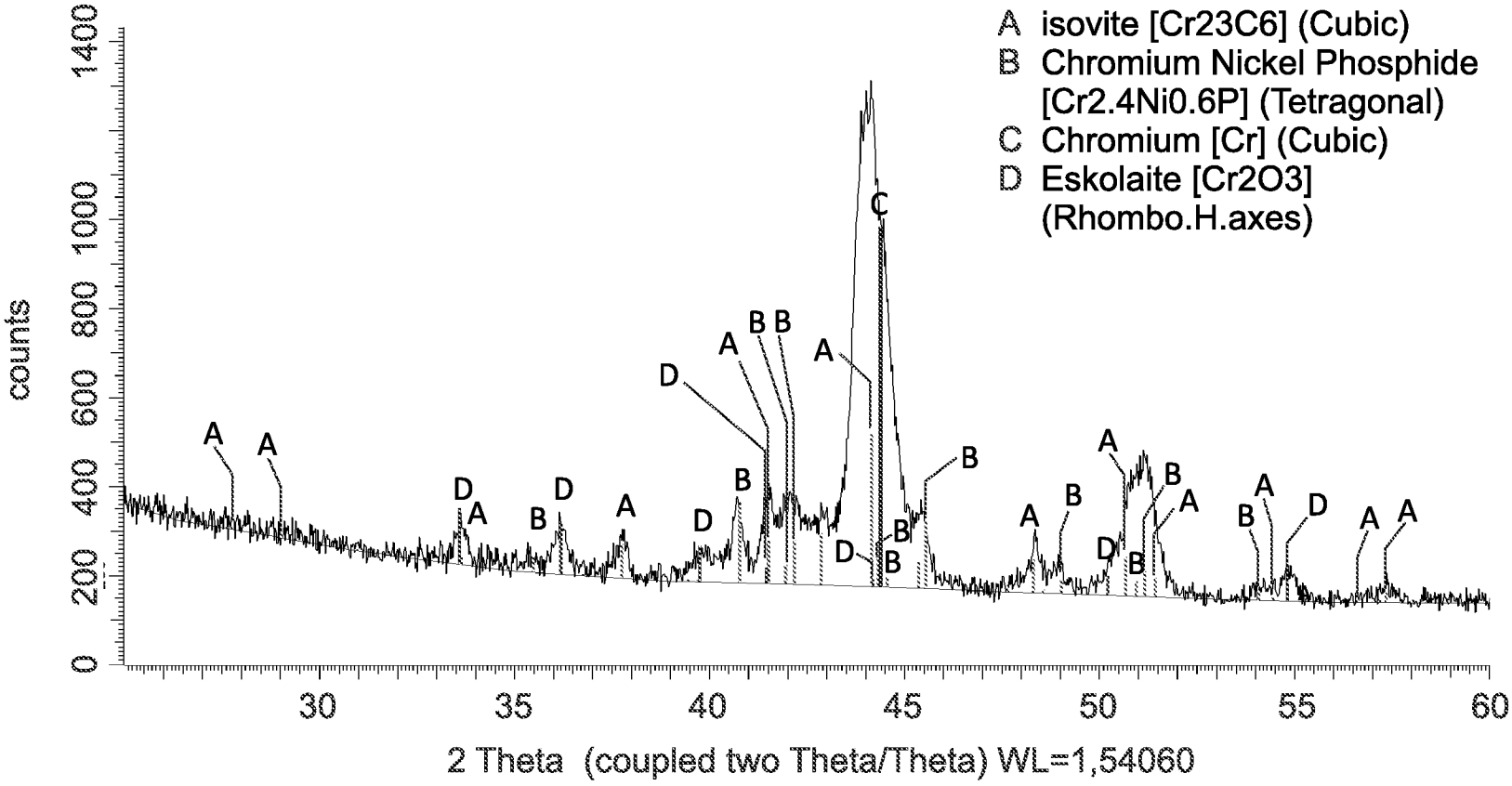
FIG. 1 depicts a part of the XRD spectrum of an embodiment of a coating according to the present disclosure.

FIG. 1 depicts a portion of the 2-theta XRD spectrum of the coating prepared above after heat treatment. The peaks present in the XRD spectrum of FIG. 1 indicate the presence of crystalline isovite ($Cr_{23}C_6$) (denoted with letter A), CrNiP ($Cr_{2.4}Ni_{0.6}P$) (denoted with letter B), metallic chromium (denoted with letter C) and eskolaite ($Cr_2O_3$) (denoted with letter D). The crystal structure of the CrNiP phase in this embodiment was tetragonal.

Example 2—Preparation of a Chromium-Containing Coating

A steel object (in this case, a shock absorber) was coated with a coating according to the present disclosure. First, a 5

μm thick NiP layer was chemically deposited on the object (step a)), after which a 7 μm thick Cr layer was electroplated on it (step b)). This was followed by 1-2-second acid treatment with 30% (w/w) HCl and the deposition of a 1 μm Ni strike layer (current density 2-5 $A/dm^{-2}$, pH 1.6) (step i)), after which steps a) and b) were repeated. After this, the object was pre-heated at 400° C. with heat pulsing, which in this case was induction heating. After preheating the object was quenched with cooling liquid. The second heat treatment was again performed through induction heating, now at 750-800° C. and quenched with cooling liquid. The pre-heating and the second heat treatment formed step c) of the method according to the present disclosure.

Figure 2:
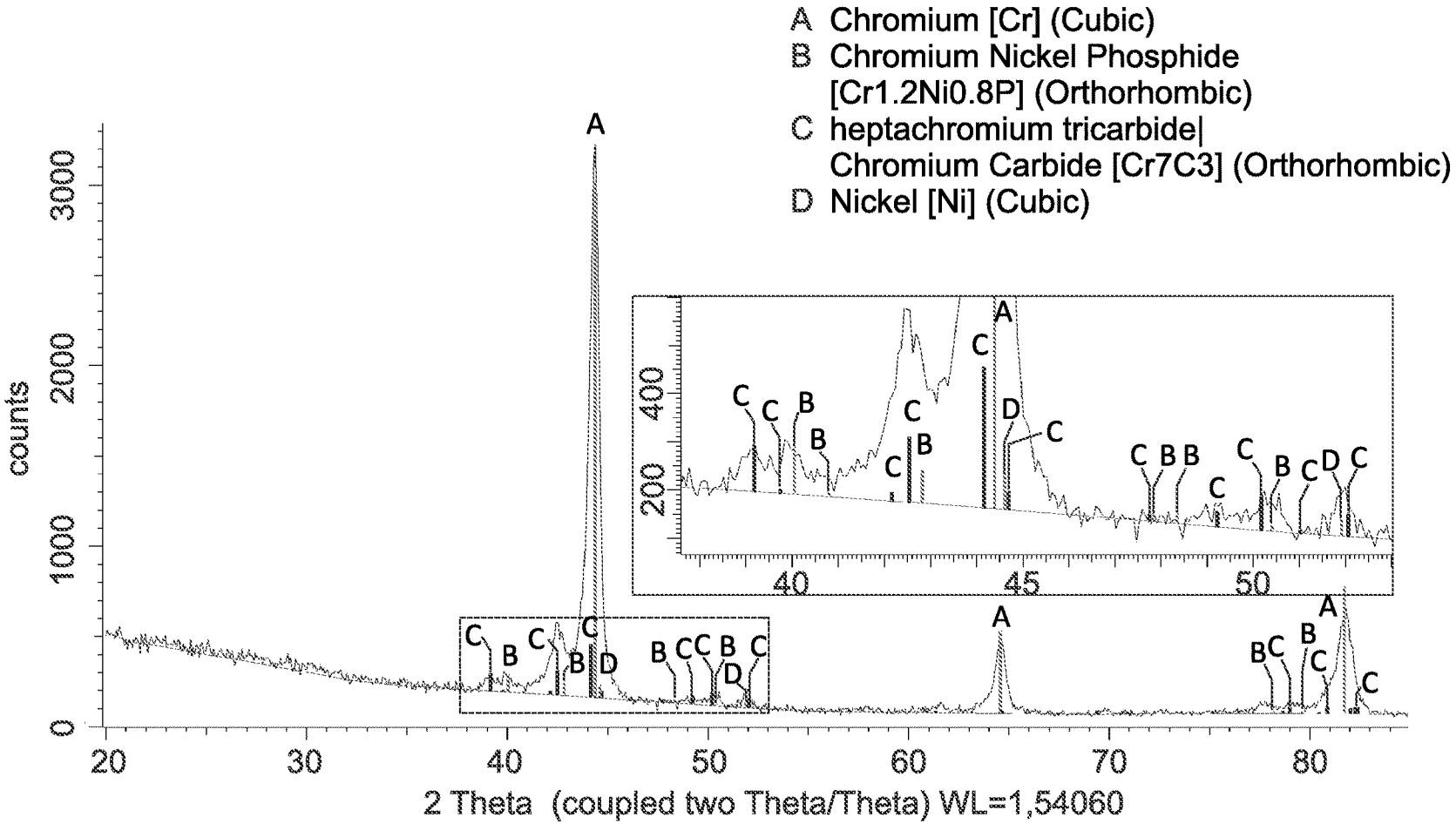
FIG. 2 depicts a part of the XRD spectrum of another embodiment of a coating according to the present disclosure.

FIG. 2 depicts a portion of the 2θ XRD spectrum of the coating prepared above after heat treatment. Also a blow-up image of a portion of the spectra is depicted. In this embodiment, metallic Cr (denoted with letter A), CrNiP ($Cr_{1.2}Ni_{0.8}P$) (denoted with letter B), heptachromium tricarbide ($Cr_7C_3$) (denoted with letter C) and metallic Ni (denoted with letter D) were present in crystal form.

The morphology of the multilayer coating was observed by scanning electron microscopy (SEM). The composition of the coating was analyzed by energy-dispersive X-ray spectroscopy (EDS) by having an electron beam follow a line in a sample image and generating a plot of the relative proportions of previously identified elements along the spatial gradient.

Figure 3:
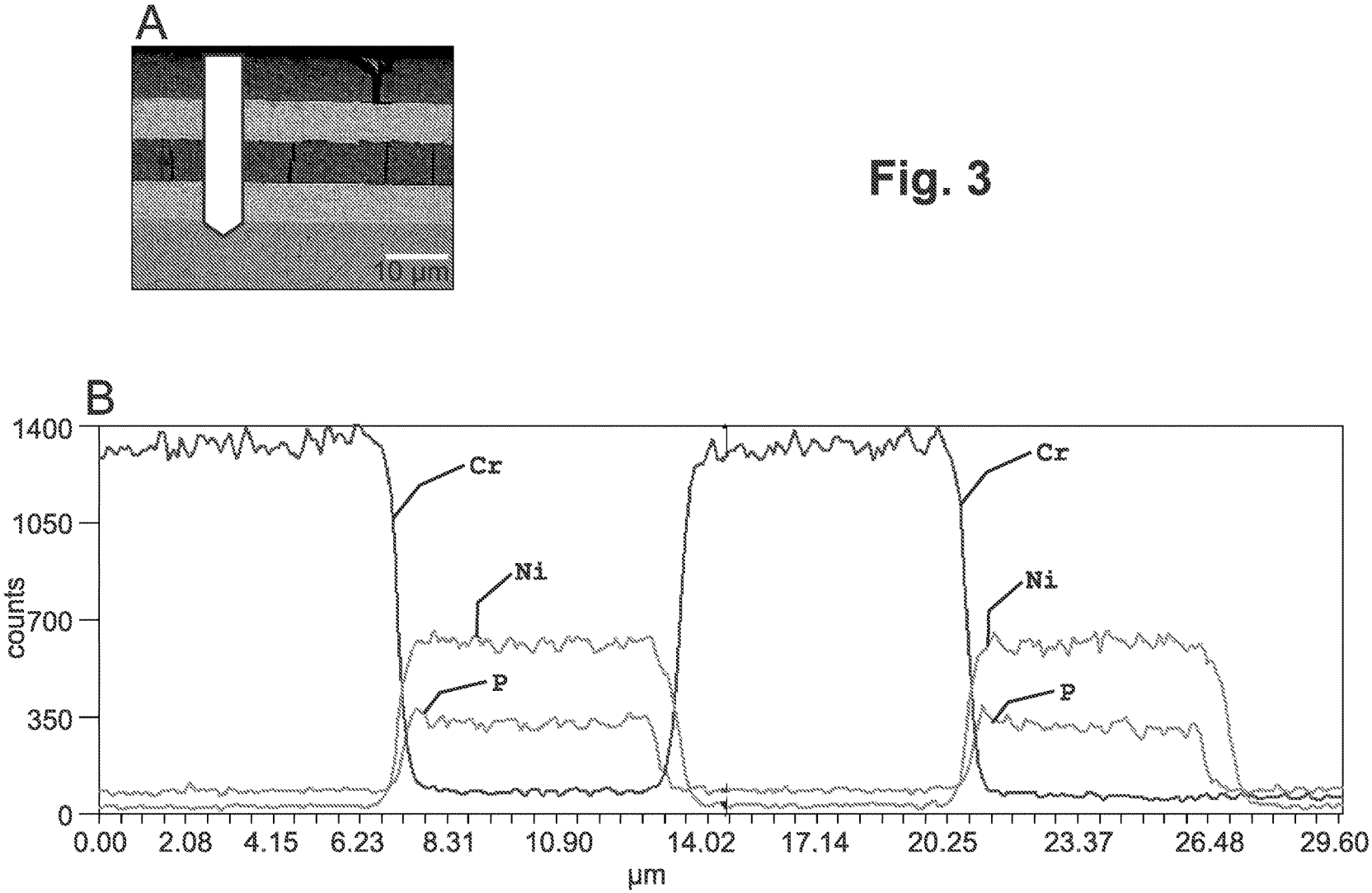
FIG. 3A depicts a SEM image of the coating presented in FIG. 2
FIG. 3B is an EDS spectrum of a coating of FIG. 2.

FIG. 3A depicts the SEM image of the coating prepared by the above method. The vertical arrow indicates the orientation of the coating so that the tip of the arrow points towards the coated substrate. The substrate is visible as the dark gray layer at the bottom of FIG. 3A and the lighter gray layer above it is the layer rich in crystalline phase or phases of nickel (Ni) and/or Ni compounds. Above this layer is a dark grey layer which is a layer rich in crystalline phase or phases of chromium (Cr) and/or Cr compounds. Then the Ni-rich and Cr-rich layers are repeated. The scale bar in the lower right corner of FIG. 3A is 10 μm in length and the intensity bar above the micrograph indicates signal strength.

FIG. 3B shows the EDS spectrum of the coating of FIG. 3A. The Cr-rich layer closest to the surface of the coating is on the left and the substrate on the right. The scan coincides with the arrow in FIG. 3A. Prominent layers rich in either Cr or Ni and P, respectively can be identified in FIG. 3B. However, there are interface layers containing all three elements detectible between these layers.

Figure 4:
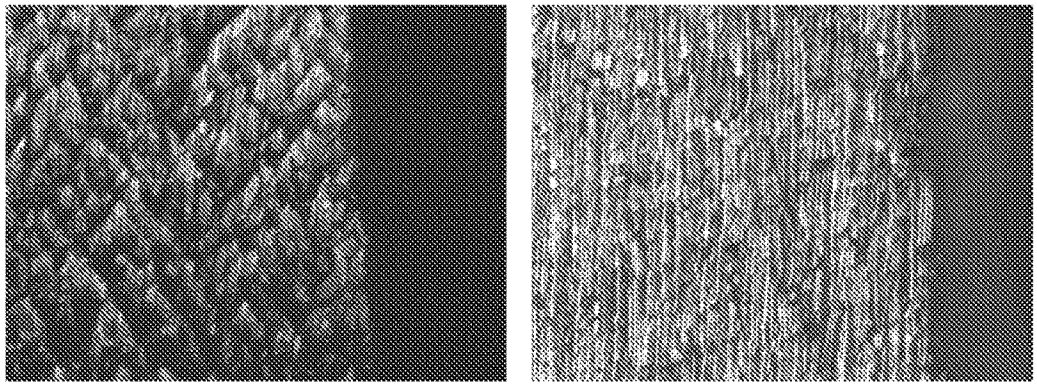
FIG. 4 depicts the results of a bending test of a coated object according to the present disclosure.

FIG. 4 displays the results of a bending test comparing the coating prepared above to a prior-art hard chromium coating. In the test, the object to be tested rests on two supports that are at a distance of 160 mm from each other. Pressure is exerted on the object at the middle of the supports to induce bending in the object.

On the left, a microscopic image of a hard chromium-coated shock absorber coated with a method known in the art is shown. On the right, a shock absorber coated with the method described above is shown. The images are a 100× magnifications of the surface of the coating from the side that is distal to the exerted pressure, i.e. the results of tensile stress on the coating are displayed. The thickness of the coating in both cases was 15 μm and the bending of the compared objects equal.

The difference between the coatings is clearly visible: the prior art coating exhibits extensive delamination (i.e cracking and scaling), which will lead to impairment of the corrosion resistance of the shock absorber when used. The coating according to the present disclosure, however, displays a much lower degree of delamination resulting in better corrosion resistance of the shock absorber. This is indicative of how brittle or tough the coating is. A tough coating, such as the one on the right in FIG. 4 does not break upon bending.

Figure 5:
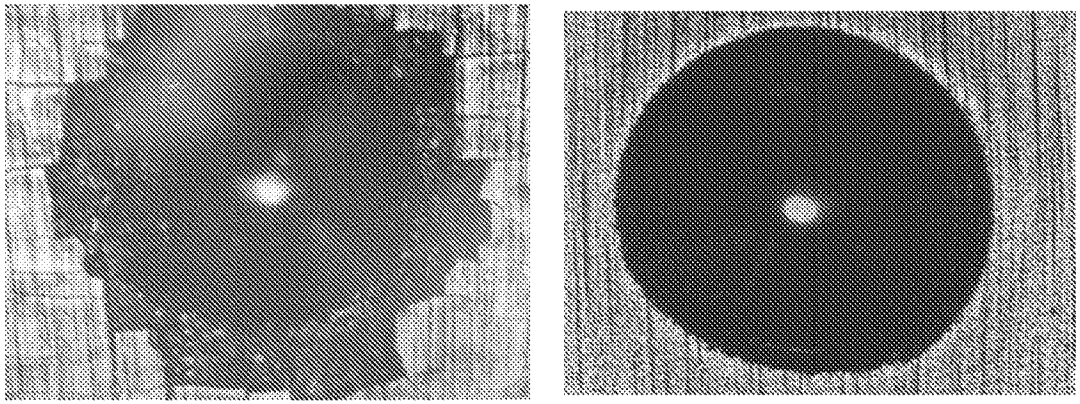
FIG. 5 depicts the results of an adhesion test of a coated object according to the present disclosure.

FIG. 5 depicts the results of an adhesion test comparing the coating prepared above to a prior-art chromium coating produced by the use of trivalent chromium. Rockwell HRC hardness test method (also known as the Daimler-Benz adhesion test) was used as the test for adhesion. In this method, a diamond indenter is pressed against the object to be tested and the edges of the indentation left by the indenter are examined for cracks and detachment of the coating from the substrate.

On the left in FIG. 5, a microscopic image of a shock absorber coated with a trivalent chromium coating method and containing a Ni underlayer known in the art is shown. On the right, a shock absorber coated with the method presented above is shown. The images are a 100× magnifications of the surface of the coating. The thickness of the coating in both cases was 15 μm.

FIG. 5 displays the mark left by the indenter as a dark circle in the middle of each panel. In the reference shock absorber on the left, the coating severe detachment from the substrate: the substrate around the indentation is exposed. On the right, the coating according to the present disclosure remains attached to the substrate and does not display any cracking. The coating according to the present disclosure thus has better scratching and impact resistant properties.

Figure 6:
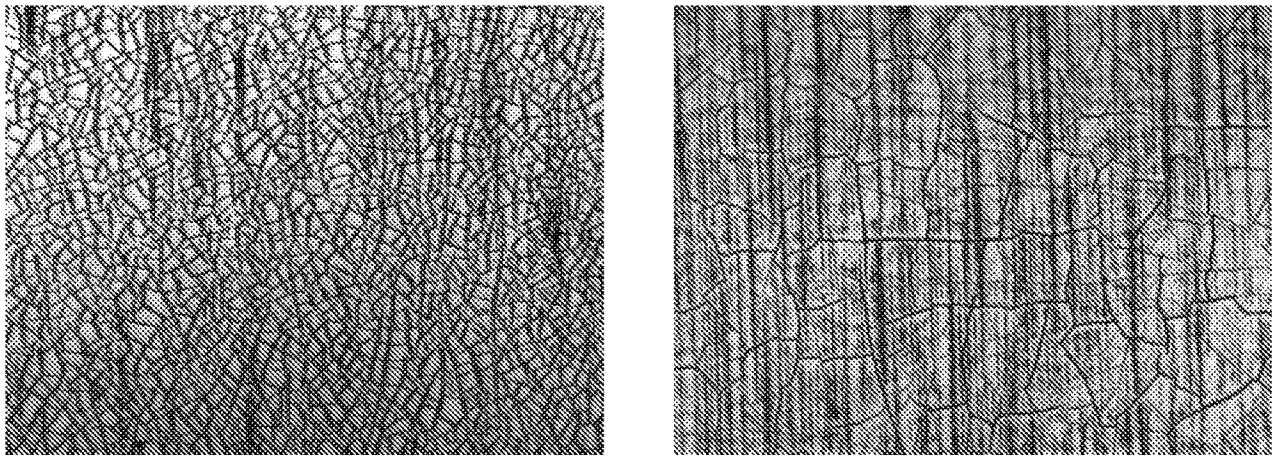
FIG. 6 shows the surface structure of a coating with different times between heating and cooling of an object.

FIG. 6 shows the surface structure of a coating with different times between heating and cooling of an object. In FIG. 6 on the left, coating according to the present disclosure is depicted, wherein the coating was heated with an induction coil moving along the surface at a speed of 1,500 mm $min^{-1}$ followed by a cooling liquid loop moving with the same speed 25 mm behind the induction coil. On the right, on the other hand, coating according to the present disclosure is depicted, wherein the distance between the induction coil and the cooling liquid loop was 10 mm while other parameters of the treatment remained the same.

It is evident from FIG. 6 that the surface structure of the coating is influence by the length of time between heating and cooling. On the left, the network of cracks is much denser than on the right. By adjusting the time between the end of the heating and the beginning of the cooling, it is thus possible to change the surface structure of the coating. The surface structure plays a role in, for example, lubricating properties as well as corrosion and wear resistance of the coating, which are thus also adjustable through the method parameters.

Figure 7:
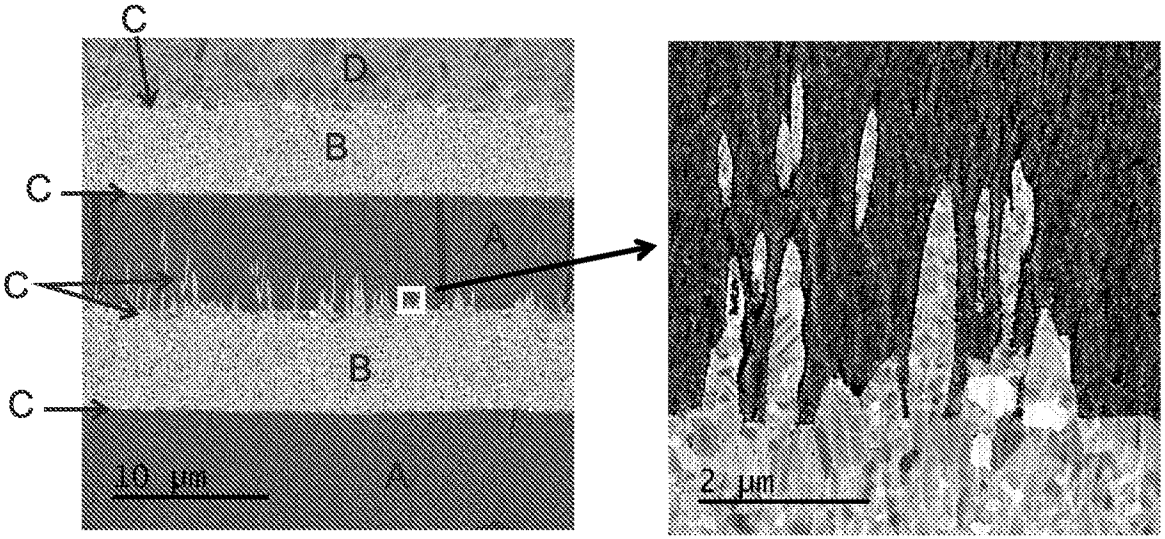
FIG. 7 displays a cross-section view of an ion-etched coating according to the present disclosure.

FIG. 7 displays a cross-section view of an ion-etched coating according to the present disclosure. The panel on the left is an overview of the coating with the surface of the coating towards the bottom of the figure. The panel on the right is a magnification of the box indicated in the panel on the left. The dark grey layers (A) indicate Cr-rich layers. Cracks are visible in the Cr layers. The light grey layers (B) indicate Ni-rich layers and the mid-grey layer (C) at the top of FIG. 7 is the metal substrate. Interface layers (C) are visible between the mentioned layers. As is evident from FIG. 7, the composition and structure of the interface layers can vary and they can be multiphase layers. These variations are determined by the specifics of the coating method and by the structure and composition of the layers next to the interface layers.

The embodiments of the invention described hereinbefore may be used in any combination with each other. Several of the embodiments may be combined together to form a further embodiment of the invention.

It is obvious to a person skilled in the art that with the advancement of technology, the basic idea of the invention may be implemented in various ways. The invention and its embodiments are thus not limited to the examples described above; instead they may vary within the scope of the claims.

The invention claimed is:

1. A chromium-based coating comprising a plurality of layers including at least one layer rich in crystalline phase or phases of nickel (Ni) and/or Ni compounds, and at least one layer rich in crystalline phase or phases of chromium (Cr) and/or Cr compounds, Cr being electroplated from a trivalent chromium bath, characterized in that the chromium-based coating further comprises one or more crystalline phases of chromium-nickel-phosphorus (CrNiP) produced by heat treating a coating comprising at least one layer of nickel-phosphorus (NiP) and at least one layer of crystalline Cr, wherein at least one of the plurality of layers of the chromium-based coating is a multiphase layer and comprises, in addition to crystalline Cr, at least chromium carbide, and wherein the hardness of the chromium-based coating is at least 1,500 $HV_{0.005}$, on a Vickers microhardness scale.

2. A chromium-based coating according to claim 1, wherein the one or more crystalline phases of CrNiP form an interface layer between the at least one layer rich in crystalline phase or phases of Ni and/or Ni compounds and the at least one layer rich in crystalline phase or phases Cr and/or Cr compounds.

3. A chromium-based coating according to claim 1, wherein the chromium-based coating comprises at least two layers rich in crystalline phase or phases of Ni and/or Ni compounds and at least two layers rich in crystalline phase or phases of Cr and/or Cr compounds.

4. A chromium-based coating according to claim 1, wherein at least one of the layers rich in crystalline phase or phases of Ni and/or Ni compounds comprises a crystalline $Ni_3P$ phase.

5. A chromium-based coating according to claim 1, wherein the one or more crystalline phases of CrNiP are components of the at least one multiphase layer.

6. A chromium-based coating according to claim 1, wherein the multiphase layer further comprises at least one of the following: crystalline CrNiP, crystalline CrNi, crystalline Ni, chromium oxide, or a combination thereof.

7. A chromium-based coating according to claim 1, wherein a layer closest to a surface of the coating comprises crystalline Cr.

8. A chromium-based coating according to claim 1, wherein a layer closest to a surface of the chromium-based coating comprises NiP or crystalline $Ni_3P$.

9. A chromium-based coating according to claim 1, wherein the atomic ratio of the one or more crystalline phases of CrNiP is $Cr_{10.08}Ni_{1.92}P_7$, $Cr_{0.75}Ni_{0.25}P$, $Cr_1N_1P_1$, $Cr_{2.4}Ni_{0.6}P$, $Cr_{0.65}Ni_{0.35}P_{0.10}$ or $Cr_{1.2}Ni_{0.8}P$ or any combination thereof.

10. A chromium-based coating according to claim 1, wherein the one or more crystalline phases of CrNiP comprises tetragonal CrNiP and/or orthohrombic CrNiP.

11. A chromium-based coating according to claim 1, wherein the thickness of the at least one layer of crystalline Cr is 0.05-20 μm.

12. A chromium-based coating according to claim 1, wherein the thickness of the chromium-based coating is 0.5-200 μm.

13. A chromium-based coating according to claim 1, wherein the hardness of the chromium-based coating is at least 2,000 $HV_{0.005}$ on a Vickers microhardness scale.

14. A chromium-based coating according to claim 1, wherein the Taber index of the chromium-based coating measured by the Taber abrasion test according to ISO 9352 is below 2.

15. A coated object, characterized in that it comprises a chromium-based coating according to claim 1.

16. A coated object according to claim 15, wherein the coated object is a gas turbine, shock absorber, hydraulic cylinder, linked pin, a ball valve or an engine valve.

* * * * *